US011041490B2

(12) United States Patent
Kipp et al.

(10) Patent No.: US 11,041,490 B2
(45) Date of Patent: Jun. 22, 2021

(54) PISTON COMPRESSOR WITH ENLARGED REGULATING REGION

(71) Applicant: KNORR-BREMSE SYSTEME FÜR SCHIENENFAHRZEUGE GMBH, Munich (DE)

(72) Inventors: Thomas Kipp, Munich (DE); Fedor Assonov, Munich (DE); Michael Winkler, Munich (DE)

(73) Assignee: KNORR-BREMSE SYSTEME FÜR SCHIENENFAHRZEUGE GMBH

( * ) Notice: Subject to any disclaimer, the term of this patent is extended or adjusted under 35 U.S.C. 154(b) by 125 days.

(21) Appl. No.: 16/087,491

(22) PCT Filed: Mar. 23, 2017

(86) PCT No.: PCT/EP2017/056908
§ 371 (c)(1),
(2) Date: Sep. 21, 2018

(87) PCT Pub. No.: WO2017/186415
PCT Pub. Date: Nov. 2, 2017

(65) Prior Publication Data

US 2019/0048865 A1 Feb. 14, 2019

(30) Foreign Application Priority Data

Mar. 21, 2016 (DE) ..... 10 2016 105 145.4

(51) Int. Cl.
*F04B 49/08* (2006.01)
*F04B 49/20* (2006.01)
(Continued)

(52) U.S. Cl.
CPC ..... *F04B 41/02* (2013.01); *F04B 23/04* (2013.01); *F04B 23/08* (2013.01); *F04B 35/01* (2013.01);
(Continued)

(58) Field of Classification Search
CPC ..... F04B 23/04; F04B 23/08; F04B 49/08; F04B 49/20; F04B 39/06
(Continued)

(56) References Cited

U.S. PATENT DOCUMENTS 1,445,073 A * 2/1923 Domenico ..... F04B 25/00 417/242
1,891,083 A * 12/1932 Dodge ..... F04B 39/128 417/242
(Continued)

FOREIGN PATENT DOCUMENTS

AT 135585 B 11/1933
CN 1402814 A 3/2003
(Continued)

OTHER PUBLICATIONS

International Search Report and Written Opinion for International Patent Application No. PCT/EP2017/056908; dated Jun. 8, 2017.

*Primary Examiner* — Christopher S Bobish
(74) *Attorney, Agent, or Firm* — Barnes & Thornburg LLP

(57) ABSTRACT

A piston compressor includes at least one cylinder for compressing air with a piston arranged such that it can move therein in a compression chamber arranged above the piston in the cylinder. The compression chamber is connected to an inlet arrangement for air to be compressed and to an outlet arrangement for compressed air, the piston compressor being drivable by a first drive device. The inlet arrangement includes a pre-compression device that can be driven by a second drive device with variable power and is used to increase the suction pressure at the air inlet.

18 Claims, 3 Drawing Sheets

(51) Int. Cl.

| | |
|---|---|
| ***F04B 23/08*** | (2006.01) |
| ***F04B 41/06*** | (2006.01) |
| ***F04B 23/04*** | (2006.01) |
| ***F04B 39/06*** | (2006.01) |
| ***F04B 41/02*** | (2006.01) |
| ***F04B 35/01*** | (2006.01) |
| *B61C 17/00* | (2006.01) |

(52) U.S. Cl.
CPC ..... *F04B 39/06* (2013.01); *F04B 41/06* (2013.01); *F04B 49/08* (2013.01); *F04B 49/20* (2013.01); *B61C 17/00* (2013.01)

(58) Field of Classification Search
USPC ..... 417/205, 206, 255, 254
See application file for complete search history.

(56) References Cited

U.S. PATENT DOCUMENTS 2,539,896 A * 1/1951 Dalrymple ..... F04B 39/16 417/255
2,849,173 A * 8/1958 Surdy ..... F02B 29/0406 417/203
2,881,749 A * 4/1959 Pringham ..... F02M 1/16 123/179.12
3,066,609 A * 12/1962 Hann ..... F01B 3/0085 417/206
3,291,067 A * 12/1966 North ..... F04B 1/2064 417/206
4,498,848 A * 2/1985 Petrovsky ..... F04B 39/06 417/253
5,152,677 A * 10/1992 Bauer ..... F04B 39/06 417/366
6,726,457 B2 * 4/2004 Wenzel ..... F02B 37/00 417/201
7,530,798 B2 * 5/2009 Huttar ..... F04B 25/00 417/243
8,215,922 B2 * 7/2012 Berger ..... F04B 11/0075 417/205
8,991,536 B2 3/2015 Dieckmann et al.
9,856,866 B2 * 1/2018 Moore ..... F04B 11/0091
2005/0220628 A1 10/2005 Pervaiz

FOREIGN PATENT DOCUMENTS

| | | | |
|---|---|---|---|
| CN | 101307754 | A | 11/2008 |
| CN | 102384074 | A | 3/2012 |
| DE | 102011013440 | A1 | 9/2012 |
| DE | 102011121056 | A1 | 6/2013 |
| DE | 102013113555 | A1 | 6/2015 |
| DE | 102013113556 | A1 | 6/2015 |
| JP | S53145106 | A | 12/1978 |
| JP | H07158576 | A | 6/1995 |
| JP | 2007024005 | A | 2/2007 |
| JP | 2007051615 | A | 3/2007 |
| JP | 2013174244 | A | 9/2013 |
| RU | 29328 | U1 | 5/2003 |
| RU | 2010115512 | A | 10/2011 |
| RU | 2529620 | C2 | 9/2014 |

* cited by examiner

PISTON COMPRESSOR WITH ENLARGED REGULATING REGION

CROSS REFERENCE AND PRIORITY

This patent application is a U.S. National Phase of International Patent Application No. PCT/EP2017/056908, filed Mar. 23, 2017, which claims priority to German Patent Application No. 10 2016 105 145.4 filed Mar. 21, 2016, the disclosure of which being incorporated herein by reference in their entireties.

FIELD

Disclosed embodiments relate to a piston compressor comprising at least one cylinder for compressing air with a piston, which is arranged movably therein, in a compression chamber which is arranged above the piston in the cylinder and is connected to an inlet arrangement for air to be compressed and to an outlet arrangement for compressed air.

BACKGROUND

The laid-open applications of German patent applications DE 10 2013 113 555 and DE 10 2013 113 556 each disclose a compressor system and a method for operating the compressor system depending on the operating state of a rail vehicle or depending on the current situation of a rail vehicle, in which an actuator is arranged for continuously influencing the rotational speed of the electrical drive device of the piston compressor, wherein the actuator is activated via a regulating device. The actuator permits operation of the drive device and therefore of the piston compressor to be adapted using different rotational speeds to the current operating state or the current situation of the rail vehicle.

SUMMARY

Disclosed embodiments provide an improved piston compressor with a greater regulating region of the delivery output while improving the energy efficiency and power density.

BRIEF DESCRIPTION OF THE FIGURES

Further advantages, features and possibilities of using the present disclosed embodiments emerge from the description below in conjunction with the figures.

DETAILED DESCRIPTION

Figure 1:
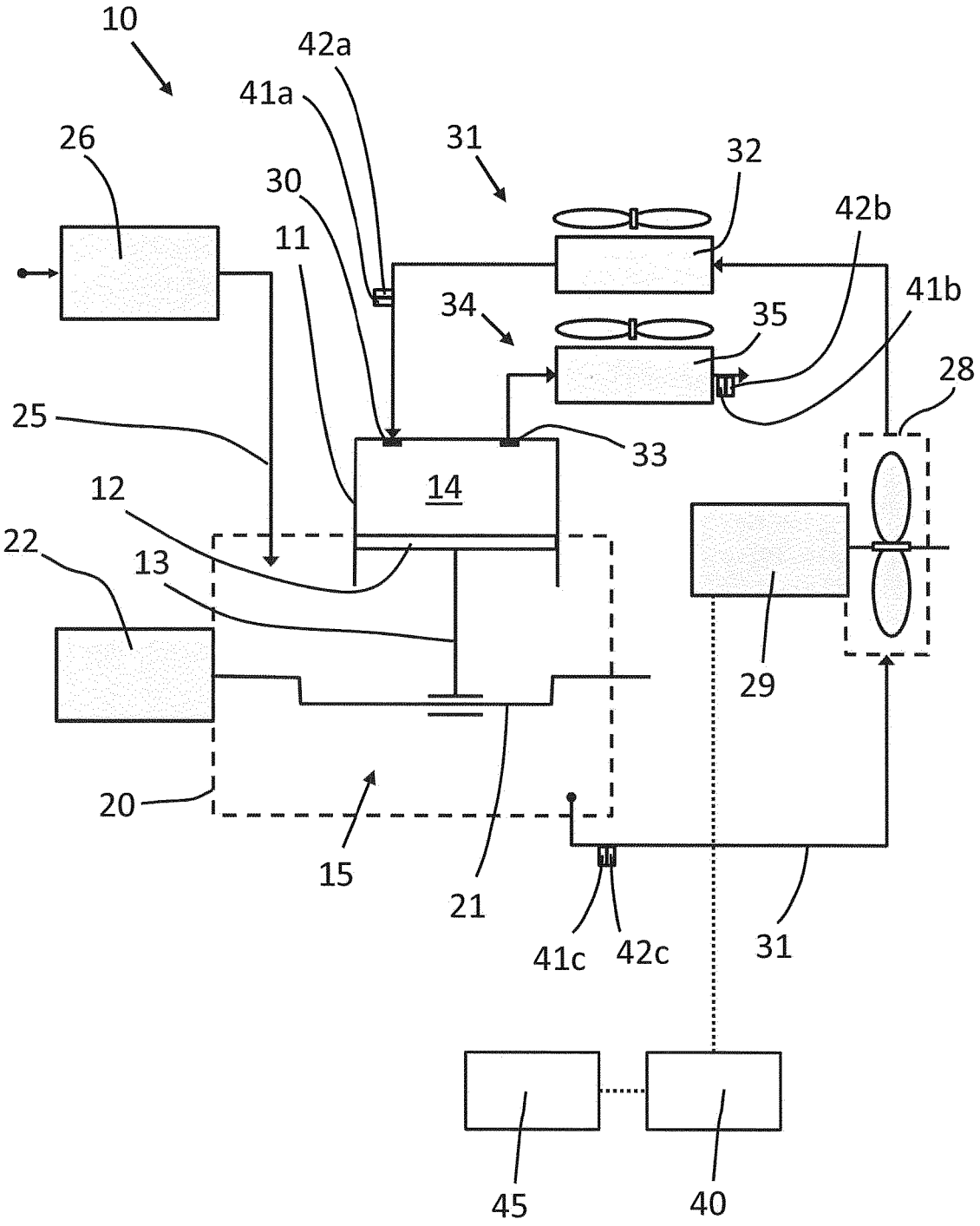
FIG. 1 shows a schematic illustration of a first embodiment of an exemplary piston compressor according to the disclosed embodiments.

Conventional piston compressors, such as in particular oil-free piston compressors for rail vehicles, serve for filling compressed air vessels from which compressed air is extracted in particular at irregular intervals. The piston compressors are customarily dimensioned for the filling mode, in which a pressure vessel is intended to be rapidly filled, which is why a maximum volumetric flow is provided. For the regulating mode, in which the compressor is operated for rather a short time under some circumstances, following prolonged interruptions and only for topping up extracted compressed air, operation with maximum volumetric flow signifies a more unfavorable operating state which could be avoided if the delivery output of such piston compressors is appropriately regulated.

The capability of known piston compressors to be regulated is limited by design-induced maximum and minimum rotational speeds. The upper rotational speed limit of in particular oil-free, dry-running piston compressors is limited by the maximum relative speed of dry-running sliding pairs. By contrast, at low rotational speeds, vibrations arise due to free mass forces in the piston compressor, as a result of which the lower rotational speed is also limited during the operation of a piston compressor. This results in an only low variability in the rotational speed of piston compressors, the variability in most applications requiring compressed air delivery in the intermittent mode.

In the case of known piston compressors, the intermittent regulation of the compressed air delivery is realized by the compressor being switched to a standstill as soon as the system pressure reaches the switch-off pressure. If the system pressure then drops to the switch-on pressure, in particular by extraction of compressed air, the piston compressor is switched into running under load, in which the piston compressor delivers a maximum volumetric flow at a nominal rotational speed. Provided that relatively great quantities of compressed air are not extracted simultaneously from the compressed air vessel or the compressed air system, the compressed air vessel fills relatively rapidly, and therefore, after a short switch-on time, the piston compressor is switched off again for a longer time. The regulating range of the known solution is therefore limited to standstill and running under load and is unfavorable and even unsuitable for certain use conditions because of the associated respective cold start and a higher degree of wear and the longer downtimes of the piston compressor.

In an alternative embodiment of a piston compressor, the intermittent load is realized at various predefined rotational speeds, for example by switching over the engine between four and six poles or by an inverter which is switchable between 50 Hz and 60 Hz. However, only a relatively restricted regulating region can also be realized in the respective compressor because of the engine rotational speeds defined here. High engine rotational speeds also bring about a severe thermal loading here in particular of oil-free sliding pairs, as a result of which the service life of a piston compressor drops significantly. Although the solution is a simple approach to regulating the volumetric flow, the regulating range is limited due to the fixed engine rotational speeds and, under certain use conditions, the switching over may not produce a sufficient volumetric flow.

The above-identified laid-open applications merely disclose a compressor system and a method for operating the compressor system depending on the operating state of a rail vehicle or depending on the current situation of a rail vehicle, in which an actuator is arranged for continuously influencing the rotational speed of the electrical drive device of the piston compressor, wherein the actuator is activated via a regulating device. The actuator permits operation of the drive device and therefore of the piston compressor to be adapted using different rotational speeds to the current operating state or the current situation of the rail vehicle.

To the contrary, disclosed embodiments provide an improved piston compressor with a greater regulating region of the delivery output while improving the energy efficiency and power density.

Disclosed embodiments provide a piston compressor comprising at least one cylinder for compressing air with a piston, which is arranged movably therein, in a compression chamber arranged above the piston in the cylinder is proposed. The compression chamber has an air inlet and an air outlet and is connected at the air inlet to an inlet arrangement for air to be compressed and is connected at the air outlet to an outlet arrangement for compressed air. The piston compressor is drivable by a first drive device. The inlet arrangement has a pre-compression device, which is drivable with variable power by a second drive device, for increasing the intake pressure, and a cooling device for cooling the air to be compressed.

The proposed solution makes it possible, using the increased intake pressure and the reduced intake temperature of the intake air, to increase the volumetric flow of a piston compressor, as a result of which the delivery output thereof increases.

The piston compressor is a piston compressor of known design with a cylinder in which a piston, which is arranged therein, is axially movable and, in a stroke movement, sucks up air to be compressed from an inlet arrangement, in particular via an inlet valve arranged at the air inlet, compresses the air and discharges same counter to a pressure in an outlet arrangement, in particular via an outlet valve arranged at the air outlet. The piston compressor is drivable here by a first drive device. Depending on the use situation of the piston compressor, the first drive device is an internal combustion engine, an electrical drive device or another suitable drive device.

A piston compressor according to the disclosed embodiments can be both a dry-running, i.e. oil-free piston compressor and a piston compressor not designed to be oil-free. Although, within the context of the disclosed embodiments, advantages or embodiments which are not usable for piston compressors other than dry-running piston compressors are also described, other advantages and embodiments are in turn also applicable independently thereof for piston compressors which are not designed to be dry-running.

In the case of the proposed piston compressor, the inlet arrangement has a pre-compression device which is drivable with variable power by a second drive device. With the pre-compression device, the intake pressure can be increased, in particular at the air inlet, in a variable manner using the variable power from an intake pressure $p_0$ up to a maximum pressure $p_{max}$. Using the higher intake pressure of the first cylinder in the case of multi-stage piston compressors or the single cylinder in the case of single-stage piston compressors, an increase in the volumetric flow by $\Delta V$ is obtained since the compression chamber of the cylinder is filled with air to be compressed which is under a higher pressure.

The second drive device, which serves for driving the pre-compression device, can also be an electrical drive device or another suitable drive device depending on the use situation. The driving power of the second drive device can also be transmitted thereto from the first drive device or from another available drive device, for example using a transmission with a variable transmission ratio. In particular, power transmitted by the second drive device is variably adjustable.

In the case of the proposed solution, the inlet arrangement has a cooling device which cools the air to be compressed, which flows through the inlet arrangement, using suitable measures. The cooling device is arranged here in particular downstream of the pre-compression device in the direction of flow of the intake air since the air is heated by the pre-compression. However, it is also possible to arrange a cooling device upstream of the pre-compression device in the direction of flow, in particular if this is advantageous because of structural conditions. In the case of this arrangement, a greater reduction in the temperature is required since the air temperature is increased again by the pre-compression. In one embodiment of the piston compressor, it can also be provided to cool the intake air upstream and downstream of the pre-compression.

The inlet arrangement in particular also has at least one conduction device which conduct the intake air to the at least one cooling device and to the at least one compression device and connect same to one another and/or to the air inlet of the compression chamber. In particular, a cooling device can also be arranged on the outside of a conduction device. Examples of suitable cooling devices of the inlet arrangement can be coolant heat exchangers or devices for enlarging the outer surface of the inlet arrangement or of a conduction device, such as conduction loops or cooling fins which are used, for example, in conjunction with fans, or any other suitable type of device, through which the thermal energy can be extracted from the intake air flowing in the inlet arrangement.

The proposed solution makes it possible to increase the volumetric flow of a piston compressor by the factor $p_{max}/p_0$ of the pre-compression device. Using the increased intake pressure and the reduced intake temperature of the intake air, the delivery output of the piston compressor increases. The variable power of the pre-compression device in conjunction with the increase in power of the piston compressor permits an upwardly broader regulating range of the piston compressor. The use of piston compressors of an overall smaller size is thus also possible since higher volumetric flows are realized using the increased intake pressure. The proposed solution permits a regulated compressor mode with briefly very high power during the filling mode (large volumetric flow of the piston compressor) and a constant operation at low power (lower volumetric flow of the piston compressor) in the regulating mode. There is therefore no risk of vibrations due to free mass forces at low rotational speeds, and the maximum relative speeds of in particular oil-free sliding pairs can be maintained. In addition, the overall temperature level of a piston compressor can be reduced by the proposed solution.

The proposed solution therefore increases the regulating region of the volumetric flow and therefore the delivery output of a compressor, leads to a reduction in the relevant temperature levels and at the same time increases the energy efficiency and power density of the piston compressor.

The piston compressor is driven via a crankshaft which is mounted rotatably in a crankcase. One or more connecting rods in each case connected to a piston are mounted rotatably at an eccentric position of the crankshaft in such a manner that the rotational movement thereof is transmitted as a stroke movement to the piston moving axially in a cylinder. The piston compressor has at least one cylinder for compressing air, but may also have two or more cylinders which are arranged successively or in parallel and are provided for compressing air using a respective piston arranged movably therein, and therefore the piston compressor can be of single-stage or multi-stage design.

In one embodiment of the piston compressor, the latter has a crankcase in which a crankshaft is arranged, on which at least one connecting rod which is connected to a piston is rotatably mounted, wherein the intake air of the at least one cylinder is guided through the crankcase.

In this embodiment, the intake air of the at least one cylinder is guided through the crankcase, wherein it flows over the elements of the crank drive, essentially the crankshaft, the connecting rods, the lower side of the piston or of the pistons, and also the bearing elements arranged in-between, and cools same. The intake air is essentially the air which is subsequently sucked into the at least one cylinder of the piston compressor and is compressed there.

In one embodiment of the piston compressor, the inlet arrangement has an air-diverting device. This embodiment makes it possible to guide a greater volumetric flow through the crankcase than is later picked up as intake air in the at least one cylinder of the piston compressor and compressed there. The volumetric flow of cooling air in the crankcase can thus be increased and at the same time the heating of the intake air as it flows through the crankcase can be reduced.

The air-diverting device can be designed, for example, in the form of a nonreturn valve or pressure control valve which is opened above a predetermined pressure of the intake air. However, the air-diverting device can also be designed in such a manner that it is openable and closable depending on predetermined parameter values, in particular using a control device. In one embodiment of an air-diverting device, excess intake air is in particular conducted out of the inlet arrangement into the surroundings; in another embodiment of an air-diverting device, for example, a predetermined portion of the cooled volumetric flow of the intake air can be returned to the crankcase.

In a further embodiment of the piston compressor, there is an after-cooling device for cooling the compressed air after passage through the at least one cylinder of the piston compressor. In particular, the outlet arrangement has an after-cooling device for cooling the compressed air. The compression causes the air in the cylinder to heat up, and therefore the compressed air which is discharged out of the compression chamber through the air outlet has an increased temperature. Cooling of the compressed air using at least one after-cooling device of the outlet arrangement after passage through the at least one cylinder simplifies, for example, subsequent storing of the air or further processing, for example dehumidification of the air. In one embodiment of the piston compressor, the after-cooling device of the outlet arrangement is formed by a partition of the cooling device for cooling the intake air of the inlet arrangement.

In a further embodiment, the piston compressor has a regulating device with which the power of the pre-compression device and therefore the intake pressure at the air inlet can be regulated, in particular in an infinitely variable manner. The regulating device here is operatively connected to the second drive device which drives the pre-compression device with a variable power. The regulating device here receives signals and/or measured values which are connected in particular to the required delivery output of the piston compressor and through which the regulating device adjusts the power of the second drive device and therefore of the pre-compression device. The degree of pre-compression of the air flowing through the inlet arrangement into the cylinder using the pre-compression device is thereby regulated.

Disclosed embodiments provide a method for controlling a piston compressor of the above-described type is furthermore proposed, wherein the regulating device regulates the power of the pre-compression device between a maximum value, which corresponds to a maximum intake pressure ($p_{max}$) at the air inlet, and a minimum value, which corresponds to the intake pressure ($p_0$), which is produced by the piston stroke movement in the cylinder, at the air inlet. The delivery output of the piston compressor is therefore adjustable, in particular in an infinitely variable manner, by the method according to the disclosed embodiments in an enlarged regulating region between a maximum intake pressure and a minimum intake pressure at the air inlet. The regulating region of the volumetric flow of the compressor is thereby enlarged, with the energy efficiency and the power density being increased.

In one embodiment of the method for controlling the piston compressor, the regulating device is connected in terms of signaling to at least one signal transmitter and/or to at least one sensor, wherein the regulating device regulates the power of the pre-compression device depending on at least one value and/or signal from the at least one signal transmitter and/or sensor. Values or signals relevant to the respectively currently required delivery output of the piston compressor from at least one sensor and/or at least one signal transmitter are transmitted here to the regulating device, the regulating device determining the currently required volumetric flow therefrom and regulating the power of the pre-compression device in accordance with this requirement. The volumetric flow of the piston compressor can thereby be adapted using the regulating device, for example depending on a current requirement, on the operating state or on the current situation of the system having the compressor, such as, for example, a rail vehicle.

In a further embodiment of the method, the regulating device receives values from at least one sensor. For this purpose, the at least one sensor is selected from a group which in particular comprises pressure sensors, temperature sensors, volumetric flow sensors, rotational speed sensors or other suitable sensors. These sensors detect parameter values which are relevant in particular for the regulation of the pre-compression device. A suitable pressure sensor detects, for example, the pressure in the pressure system which is supplied by the piston compressor. The pressure sensor can be positioned, for example, on the outlet arrangement upstream or downstream of an after-cooling device, which is optionally arranged there, or in the compressed air vessel. Depending on the detected pressure value in the compressed air system, rapid filling may be required, with a high delivery output of the piston compressor being required, or topping up of smaller amounts of extracted compressed air, which can take place more economically with a lower delivery output.

The volumetric flow extracted from the compressed air system can be directly detected using a volumetric flow sensor. This value also influences, for example, the required amount of compressed air during the topping-up mode of the piston compressor. Using a rotational speed sensor which transmits the rotational speed of the crankshaft to the regulating device, a value for the volumetric flow which flows through the intake arrangement can be derived during the method for controlling the piston compressor. For example, with a temperature sensor, the air temperature in the crankcase, in the inlet arrangement, in the outlet arrangement or in the compressed air system can be detected, from which it is likewise possible to derive different requirements regarding the delivery output of the piston compressor, which delivery output can be adapted with the aid of the regulating device.

In one embodiment of the method for controlling a piston compressor, the regulating device is connected in terms of signaling to at least one signal transmitter which is selected from a group which comprises operating management systems, control devices, such as a control device of the first drive device, or other suitable devices which process information relevant for the controlling of the delivery output of the piston compressor. For example, a regulating device for a piston compressor obtains values from a vehicle management system relating to the current operating state of a vehicle, such as driving speed, braking operation or track operation and the like, from which the compressed air use at the particular moment and the currently required filling state of the compressed air system can be derived. Also on the basis of signals from the control device of the first drive device, the regulating device can derive information with regard to the current operating situation and the operating state of the system in which the piston compressor is currently used, and can determine and use control values therefrom for the required volumetric flow of the piston compressor.

In one embodiment of the method for controlling a piston compressor, the regulating device regulates the power of the cooling device independently of the power of the pre-compression device. The desired values for the power of the cooling device can be directly transmitted here to the regulating device. The regulating device can likewise also determine the desired value, which is to be adjusted, in particular depending on sensor values or signal transmitter values which, for example, contain the temperature of the surroundings, in the crankcase or in the compressed air vessel. A greater or lower cooling power of the cooling device may be required here independently of the power of the pre-compression device in order, for example, to bring about greater or lower compression of the air in the piston compressor, or in order to indirectly influence the temperature level of the pressure system using a lower or higher temperature of the intake air of the piston compressor.

FIG. 1 shows a schematic illustration of a first embodiment of an exemplary piston compressor 10 according to the disclosed embodiments. The piston compressor 10 which is oil-free in the exemplary embodiment, i.e. is dry-running, has a crankcase 20 and a piston 21 which is arranged therein, is connected to a first drive device 22 and is driven by the latter. The piston compressor 10, which is illustrated in single-stage form in the exemplary embodiment, has a cylinder 11 with a compression chamber 14 for compressing air using a piston 12 which is arranged in the cylinder 11 and is driven via a connecting rod 13, which is mounted rotatably eccentrically on the crankshaft 21.

The cylinder 11 has an air inlet 30 which is connected to an inlet arrangement 31 which guides air which is to be compressed to the air inlet 30 of the compression chamber 14. Furthermore, the cylinder 11 has an air outlet 33 which is connected to an outlet arrangement 34 which receives compressed air from the compression chamber 14. The crankshaft 21 together with the connecting rod 13 and the bearings, which are arranged thereon and therebetween, forms the crank drive 15 which heats up within the crankcase 20 during the operation of the piston compressor 10.

The crankcase 20 of the exemplary embodiment is connected via an air supply line 25 to an air filter 26 via which ambient air is sucked up and guided into the crankcase 20 via the air supply line 25. The inlet arrangement 31 is arranged on a region of the crankcase 20 that is remote from the connection of the air supply line 25, and therefore the air guided by the air supply line 25 into the crankcase 20, after flowing through the crankcase 20, can leave the latter again through the inlet arrangement 31. The air flow formed in the process flows in particular over the elements of the crank drive 15 and, in the process, absorbs thermal energy while simultaneously cooling the crank drive 15.

The inlet arrangement 31 has a pre-compression device 28 in the form of an external high power fan which is driven by a pre-compressor drive (second drive device) 29. Using the action of the pre-compressor device 28, ambient air is sucked through the air filter 26 into the crankcase 20 where it flows over the elements of the crank drive 15 and extracts thermal energy from them in the process. The pre-compression device 28 sucks the heated air, after the latter has flowed through the crankcase 20, into the inlet arrangement 31, compresses the air and, in the process, depending on the current power of the pre-compressor drive 29, builds up a pressure, which is increased in relation to the ambient pressure, at the air inlet 30 upstream of the cylinder 11. Using this increased pressure at the air inlet 30, more air can flow into the compression chamber 14 during an intake stroke of the piston 12, as a result of which the delivery output and efficiency of the piston compressor 10 are increased.

In the case of the exemplary embodiment of FIG. 1, the inlet arrangement 31 between the pre-compression device 28 and the cylinder 11 has a cooling device 32 which cools the air flowing through the inlet arrangement 31. Both during the flow through the crankcase 20 and because of the pre-compression in the pre-compression device 28, the intake air is heated up, which leads to an enlargement of the volume, which brings about a reduction in the quantity of air which can be received in the compression chamber 14 during an intake stroke. In order to counteract this effect, the inlet arrangement 31 has, downstream of the pre-compression device 28 in the direction of flow of the intake air, a cooling device 32 which cools the pre-compressed intake air. A greater quantity of air can thereby be received in the compression chamber 14. This measure further increases the delivery output and the efficiency of the piston compressor 10.

In the exemplary embodiment of the piston compressor 10, the pre-compressor drive 29 is connected to a regulating device 40 which regulates the power of the pre-compression device 28 and therefore the intake pressure at the air inlet 31. A plurality of pressure sensors 41*a*, 41*b*, 41*c* and a plurality of temperature sensors 42*a*, 42*b*, 42*c* are arranged at suitable points on the inlet arrangement 31 and on the outlet arrangement 34 of the piston compressor 10, the pressure sensors and temperature sensors each being connected in terms of signaling (not illustrated) to the regulating device 40. The pressure sensors 41*a*, 41*b*, 41*c* and the temperature sensors 42*a*, 42*b*, 42*c* transmit the respectively prevailing air temperature and the pressure at their respective position on the inlet arrangement 31 and on the outlet arrangement 34 to the regulating device 40.

Furthermore, the regulating device 40 is connected in terms of signaling to a device management system 45 which transmits further data relevant to the compressed air supply of the piston compressor 10 to the regulating device 40. From the data which the regulating device 40 receives in particular from the pressure sensors 41*a*, 41*b*, 41*c*, the temperature sensors 42*a*, 42*b*, 42*c* and from the device management system 45, the regulating device 40 determines the current requirement of the compressed air supply system and therefore the required delivery output of the piston compressor 10. With the need requirement following therefrom, the regulating device 40 correspondingly adapts the degree of pre-compression of the intake air at the air inlet 31 using the pre-compression device 28 by suitable regulation of the pre-compressor drive 29.

In a further exemplary embodiment (not illustrated) of the piston compressor 10 according to the disclosed embodiments, a power controller of the cooling device 32 and also of the after-cooling device 35 is also connected to the regulating device 40. The cooling power of the two cooling devices 32, 35 can then also be regulated using the regulating device 40 to a required cooling power in particular determined in each case.

Figure 2:
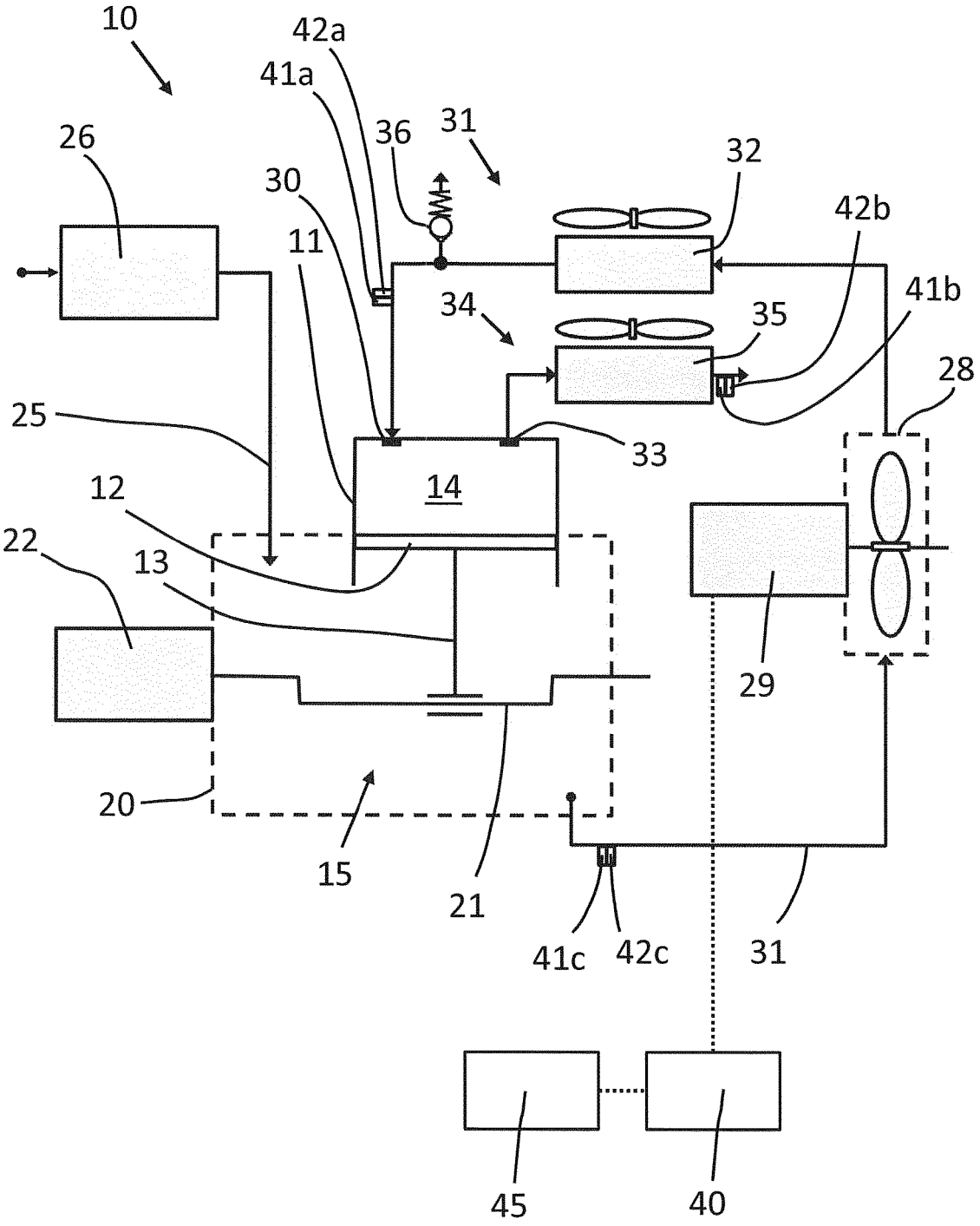
FIG. 2 shows a schematic illustration of a second embodiment of an exemplary piston compressor according to the disclosed embodiments.

FIG. 2 shows a schematic illustration of a second embodiment of an exemplary piston compressor 10 according to the disclosed embodiments. The piston compressor 10 from FIG. 2 substantially corresponds to the piston compressor 10 which is illustrated in FIG. 1 and described with respect thereto, and therefore identical elements of the piston compressors 10 are denoted by the same reference signs. Only the differences between the two schematically illustrated piston compressors 10 will be explained below.

In comparison to the piston compressor 10 from FIG. 1, the piston compressor 10 shown in FIG. 2 has an air-diverting device 36, which is arranged on the inlet arrangement 31, in the form of a pressure control valve. In the embodiment shown, the pressure control valve of the air-diverting device 36 is opened as soon as the pressure in the inlet arrangement 31 downstream of the cooling device 32 in the direction of flow of the intake air exceeds a predetermined value and conducts away the excess intake air in the inlet arrangement 31 to the surroundings of the piston compressor 10. The volumetric flow of air for cooling the crankcase 20 can thereby be greater than the delivery output of the piston compressor 10 since the excess air after flowing through the crankcase 20 and after the pre-compression can be conducted out of the inlet arrangement 31.

In this exemplary embodiment, an air volumetric flow of substantially any size through the crankcase 20 can be realized, wherein the cooling device 32 can possibly be configured to be larger than the piston compressor 10 from FIG. 1 for the increased volumetric flow. While the delivery output is identical to the piston compressor 10 from FIG. 1, the amount of the amount of air sucked up through the air filter 26 also increases.

Figure 3:
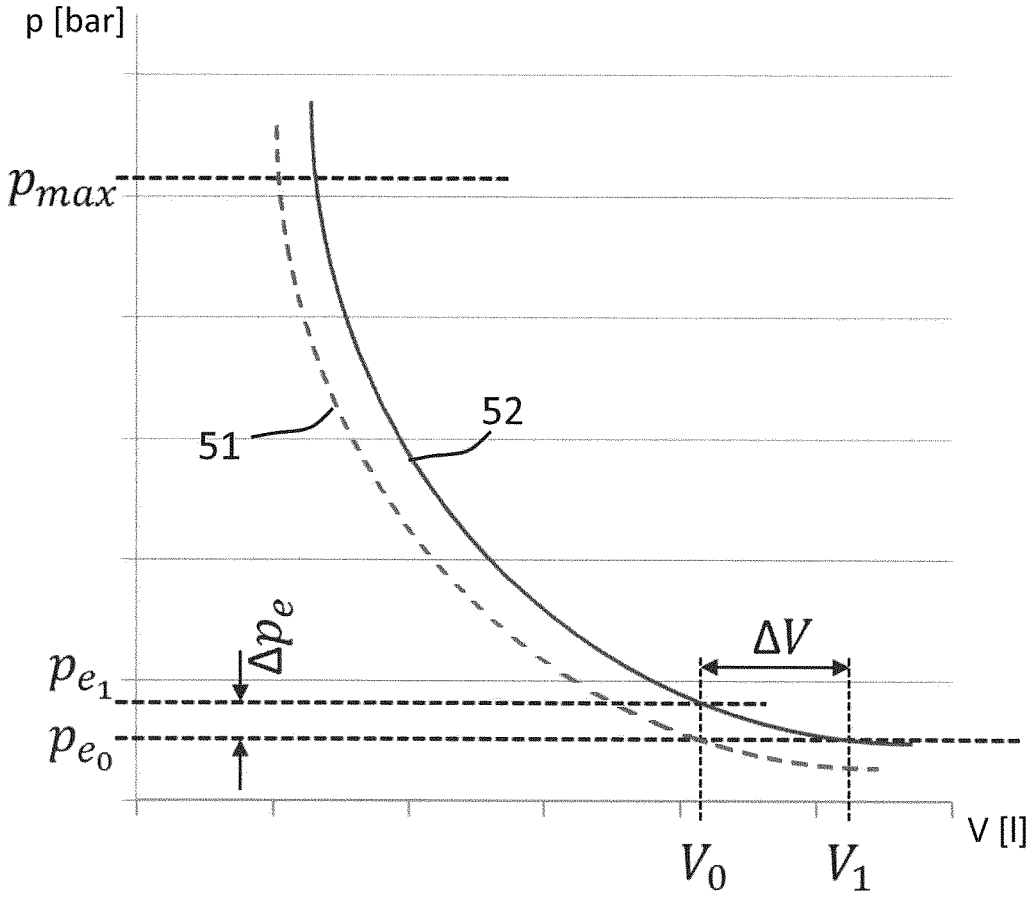
FIG. 3 shows a diagram in which the change in volumetric flow due to the increase in the input pressure is illustrated.

FIG. 3 shows a diagram which illustrates the change in the volumetric flow conveyed by the piston compressor 10 because of pre-compression and cooling of the intake air as it flows through the inlet arrangement 31. The pressure of the intake air at the air outlet 30 is illustrated above the volumetric flow conveyed by the piston compressor 10 in the diagram.

The volumetric flow 51 conveyed by a piston compressor 10 according to the prior art is shown by a curve illustrated by dashed lines. The volumetric flow 52 conveyed by a piston compressor 10 according to the disclosed embodiments is illustrated by a curve illustrated continuously.

As can be read from the diagram, the increase in the intake pressure $p_{e0}$ by $\Delta p_e$ to $p_{e1}$ by pre-compression and cooling of the intake air causes the volumetric flow to increase by $\Delta V$ to $V_1$ since the swept volume of the compression chamber $V_0$ is filled with a greater amount of air than in the case of a piston compressor 10 according to the prior art.

The features of the disclosed embodiments that are disclosed in the above description, in the drawings and in the claims may be essential both individually and in any combination for realizing the disclosed embodiments.

LIST OF REFERENCE SIGNS

10 Piston compressor
11 Cylinder
12 Piston
13 Connecting rod
14 Compression chamber
15 Crank drive
20 Crankcase
21 Crankshaft
22 First drive device
25 Air supply line
26 Air filter
28 Pre-compression device
29 Pre-compressor drive
30 Air inlet
31 Inlet arrangement
32 Cooling device
33 Air outlet
34 Outlet arrangement
35 After-cooling device
36 Air-diverting device
40 Regulating device
41*a, b, c* Pressure sensor
42*a, b, c* Temperature sensor
45 Device management system
51 Volumetric flow of a piston compressor of the prior art
52 Volumetric flow of a piston compressor according to the disclosed embodiments

The invention claimed is:

1. A piston compressor comprising:

at least one cylinder for compressing air with a respective piston, which is arranged movably therein;

a compression chamber arranged above the piston in the cylinder, wherein the compression chamber has an air inlet and an air outlet and is connected at the air inlet to an inlet arrangement for air to be compressed and is connected at the air outlet to an outlet arrangement for compressed air, wherein the piston compressor is drivable by a first drive device, wherein the inlet arrangement has a pre-compression device, the pre-compression device comprising an external fan, which is drivable with variable power by a second drive device, for increasing the intake pressure at the air inlet, and a cooling device for cooling the air to be compressed, and a crankcase in which a crankshaft is arranged, on which at least one connecting rod which is connected to the respective piston is rotatably mounted, an air supply line configured to guide ambient air into the crankcase via suction by the pre-compression device, wherein intake air of the at least one cylinder is guided through the crankcase.

2. The piston compressor of claim 1, wherein the inlet arrangement has an air-diverting device.

3. The piston compressor of claim 1, further comprising an after-cooling device for cooling the compressed air after passage through the at least one cylinder of the piston compressor.

4. The piston compressor of claim 1, further comprising a regulating device which regulates the power of the pre-compression device and the intake pressure at the air inlet.

5. The piston compressor of claim 4, wherein the regulating device regulates the power of the pre-compression device between a maximum value, which corresponds to a maximum intake pressure ($p_{max}$) at the air inlet, and a minimum value, which corresponds to the intake pressure ($p_0$), which is produced by the piston stroke movement in the cylinder, at the air inlet.

6. The piston compressor of claim 5, wherein the regulating device is connected for signaling to at least one signal transmitter and/or to at least one sensor, wherein the regulating device regulates the power of the pre-compression device depending on at least one value and/or signal from the at least one signal transmitter and/or the at least one sensor.

7. The piston compressor of claim 6, wherein the at least one sensor is selected from a group which comprises pressure sensors, temperature sensors, volumetric flow sensors and rotational speed sensors.

8. The piston compressor of claim 6, wherein the at least one signal transmitter is selected from a group which comprises operating management systems or control devices.

9. The piston compressor of claim 5, wherein the regulating device regulates the power of the cooling device independently of the power of the pre-compression device.

10. A method of controlling a piston compressor, the method comprising:

compressing air using at least one cylinder with a respective piston, which is arranged movably therein;

driving the piston compressor by a first drive device, wherein a compression chamber arranged above the piston in the at least one cylinder, wherein the compression chamber has an air inlet and an air outlet and is connected at the air inlet to an inlet arrangement for air to be compressed and is connected at the air outlet to an outlet arrangement for compressed air;

driving a pre-compression arrangement provided in the inlet arrangement with variable power by a second drive device, for increasing the intake pressure at the air inlet, the pre-compression device comprising an external fan: and cooling the air to be compressed using a cooling device, wherein a crankcase in which a crankshaft is arranged, on which at least one connecting rod which is connected to the respective piston is rotatably mounted, and an air supply line guides ambient air into the crankcase via suction by the pre-compression device, wherein intake air of the at least one cylinder is guided through the crankcase.

11. The method of claim 10, wherein the inlet arrangement has an air-diverting device.

12. The method of claim 10, wherein an after-cooling device is provided for cooling the compressed air after passage through the at least one cylinder of the piston compressor.

13. The method of claim 10, wherein a regulating device is provided which regulates the power of the pre-compression device and the intake pressure at the air inlet.

14. The method of claim 13, wherein the regulating device regulates the power of the pre-compression device between a maximum value, which corresponds to a maximum intake pressure ($p_{max}$) at the air inlet, and a minimum value, which corresponds to the intake pressure ($p_0$), which is produced by the piston stroke movement in the cylinder, at the air inlet.

15. The method of claim 14, wherein the regulating device is connected for signaling to at least one signal transmitter and/or to at least one sensor, wherein the regulating device regulates the power of the pre-compression device depending on at least one value and/or signal from the at least one signal transmitter and/or the at least one sensor.

16. The method of claim 15, wherein the at least one sensor is selected from a group which comprises pressure sensors, temperature sensors, volumetric flow sensors and rotational speed sensors.

17. The method of claim 15, wherein the at least one signal transmitter is selected from a group which comprises operating management systems or control devices.

18. The method of claim 14, wherein the regulating device regulates the power of the cooling device independently of the power of the pre-compression device.

* * * * *